United States Patent [19]

Hurt

[11] Patent Number: 4,647,046

[45] Date of Patent: Mar. 3, 1987

[54] GOLF GAME

[76] Inventor: James E. Hurt, 131 College Cir., Staunton, Va. 24401

[21] Appl. No.: 780,197

[22] Filed: Sep. 26, 1985

[51] Int. Cl.[4] ..... A63B 67/02

[52] U.S. Cl. ..... 273/176 E; 273/180

[58] Field of Search ..... 273/176 F, 176 R, 176 B, 273/176 D, 176 E, 176 FA, 176 FB, 176 G, 176 H, 176 J, 176 K, 176 H, 180

[56] References Cited

U.S. PATENT DOCUMENTS

| | | | |
|---|---|---|---|
| 1,736,316 | 11/1929 | Lasting | 273/176 H |
| 1,822,244 | 9/1931 | Smith | 273/176 F |
| 1,870,536 | 8/1932 | Vaccaro | 273/176 G |
| 2,539,046 | 1/1951 | Wright | 273/176 F |
| 2,827,299 | 3/1958 | Dean | 273/176 F |
| 3,138,387 | 6/1964 | Michel et al. | 273/176 F |
| 3,342,494 | 9/1967 | Talley | 273/176 F |
| 3,464,704 | 9/1969 | Nelson | 273/176 F |
| 3,591,176 | 7/1971 | Roth | 273/176 F X |
| 3,843,136 | 10/1974 | Buenzle | 273/176 F |
| 3,909,006 | 9/1975 | Arbaugh | 273/176 AA |
| 4,098,507 | 7/1978 | Hudon | 273/176 B X |
| 4,108,440 | 8/1978 | Delaplaine | 273/176 E |
| 4,133,534 | 1/1979 | Ikemoto | 273/176 E |

FOREIGN PATENT DOCUMENTS

| | | | |
|---|---|---|---|
| 358362 | 10/1931 | United Kingdom | 27/176 F |

*Primary Examiner*—George J. Marlo

*Attorney, Agent, or Firm*—William D. Stokes

[57] ABSTRACT

A portable, miniature golf game adapted for indoor-/outdoor use and particularly useful for wheel chair bound and prosthetic wearing persons which may be easily assembled and disassembled without special tools comprised of parts which may be interfitted together to form a variety of configurations allowing the golf holes to be disposed in varying and different situations confronting the player with a full golf game in a small area, each hole presenting different physical and mental challenges to the player. The different configurations are made from an assembly of parts which include barriers in the shape of open rectangles, and a swingable gate mounted on a threshold member provided with an inclined ramp. The gate and ramp allow wheel chairs to move onto the golf ball playing area.

14 Claims, 11 Drawing Figures

GOLF GAME

BACKGROUND OF THE INVENTION

The prior art shown of many different golf games of various shapes and configurations which are designed to simulate golf courses or putting greens with the players using conventional equipment for the play thereof. Generally, in all of these known games, a portable surface is erected and the player standing at one end putts the ball to a target hole at the opposite end, back and forth until the 9 or 18 holes are completed as in the conventional game with low score winning.

These games are typified by the following patents which were noted in a search conducted in the U.S. Patent Office: U.S. Pat. Nos. 1,736,316; 3,843,136; 1,870,536; 3,909,006; 2,539,046; 4,098,507; 3,138,387; 4,108,440; 3,342,494; 4,133,534; and 3,464,704.

SUMMARY OF THE PRESENT INVENTION

The golf game of the present invention is assembled by connecting a plurality of four substnatially identical types of members, name, u-shaped members, greens members, floor members and leg members, relative to one another to form a desired course layout to present different physical and mental problems. Golf cups are disposed in the greens which are enclosed in the u-shaped members, the u-shaped members and the legs serving to enclose and form the fairway. The floor pieces are arranged to form the fairway approach to the greens. The covering of the floor pieces and greens may be selected from carpet, simulated grass or a combination thereof to enhance the play thereof. If desired the floor pieces do not have to be used where it is desired to use the ground or floor of a room as the fairway. A unique feature of the covering and it's association with the support in one embodiment of the invention is that the support is designed to accommodate an extra amount of covering to permit the same to be undulated to vary the difficulty of the lie adjacent several of the holes. One of the most important elements of the construction inables wheelchair bound or prosthetic wearing persons to move onto and out of the course without difficulty.

DETAILED DESCRIPTION OF THE DRAWINGS

Figure 1:
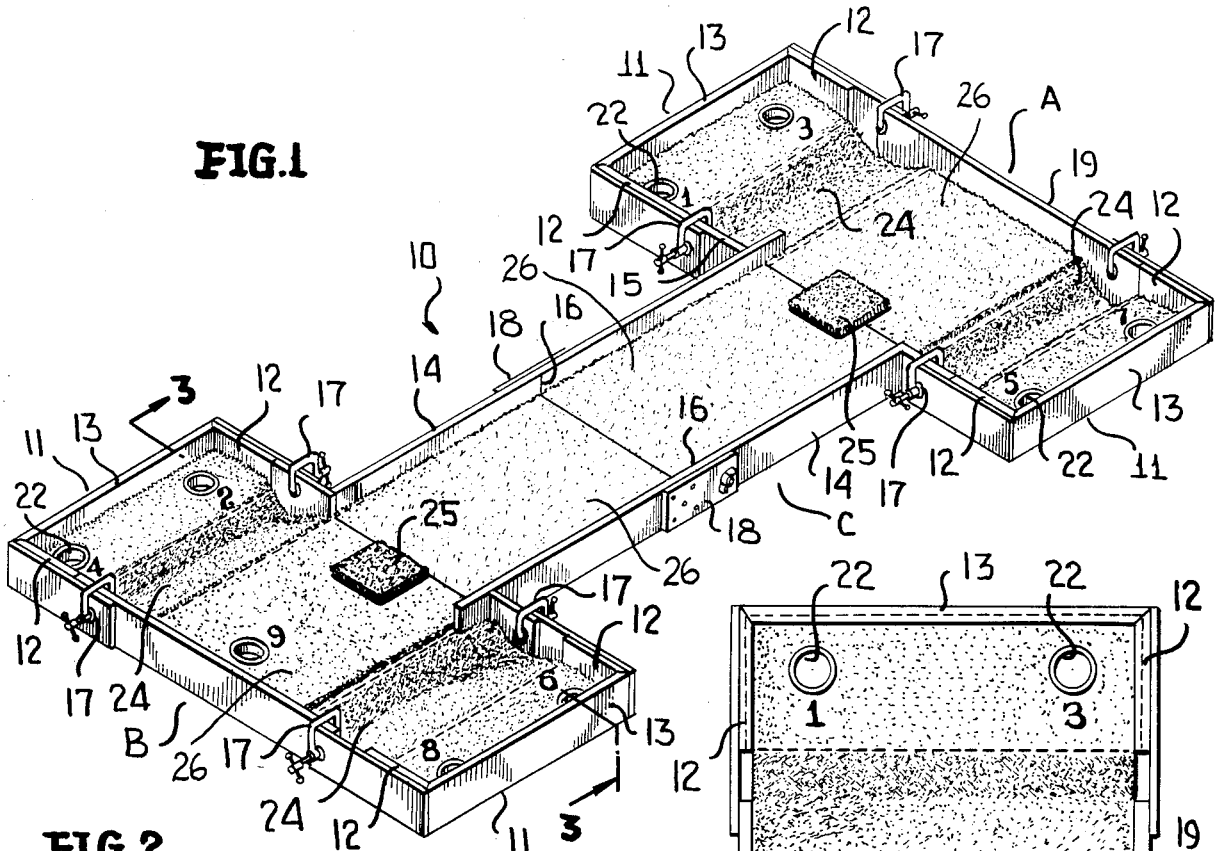
FIG. 1 is a perspective view of one embodiment of the golfing game according to the present invention.
Figure 2:
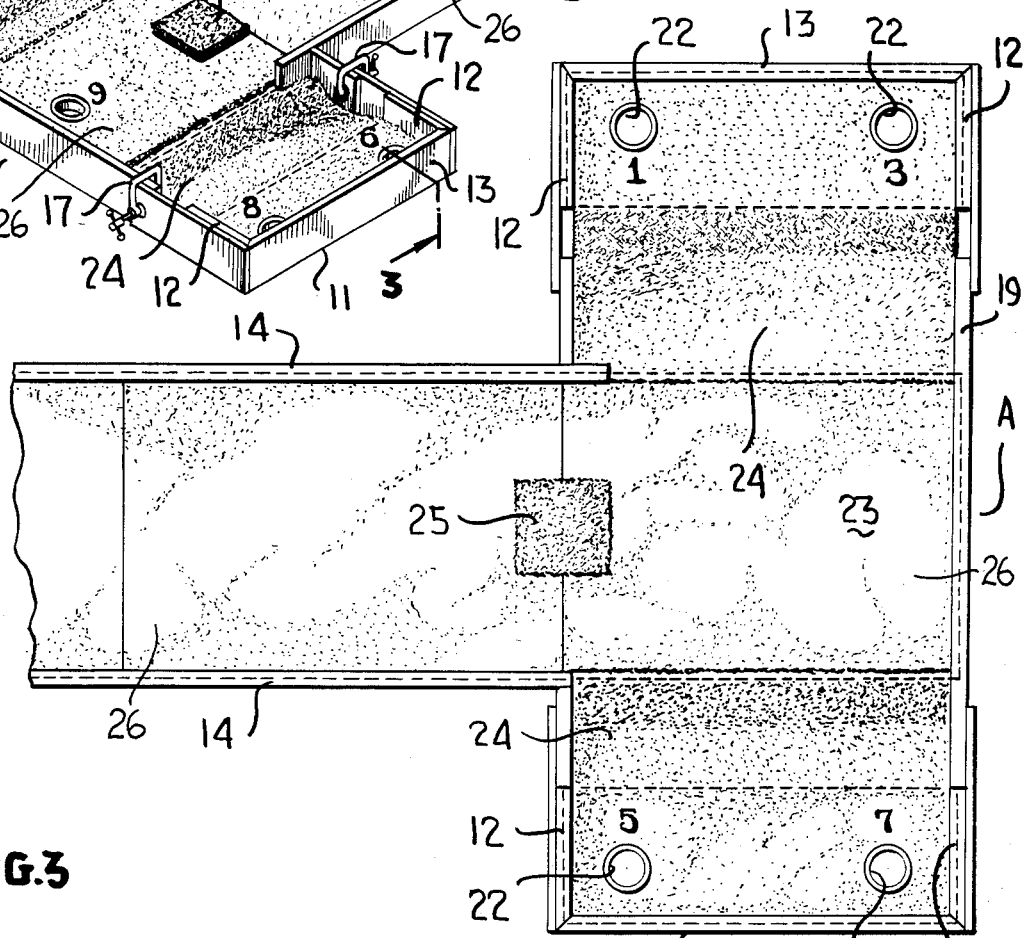
FIG. 2 is an enlarged view showing construction details of one end of the embodiment of FIG. 1.
Figure 3:
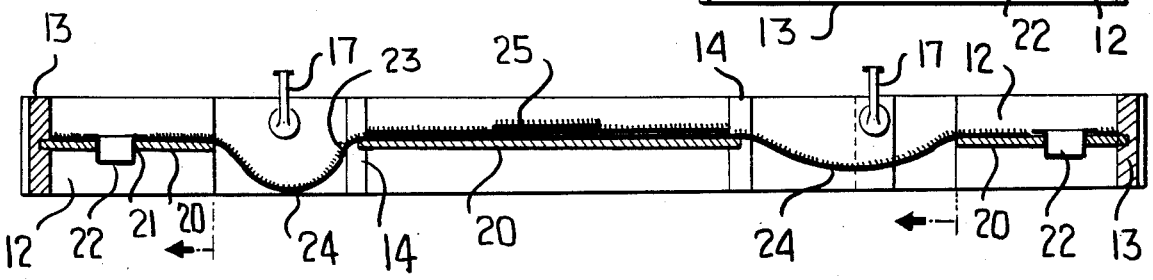
FIG. 3 is a sectional view taken on line 3—3 of FIG. 1 showing further details of the construction.

With reference to FIGS. 1 and 2 which illustrates an embodiment of the same for a relatively permanent set up, the frame of the golf game is generally depicted as 10 and is seen to include two end units A, B, interconnected by cross member C. Upon close inspection of this Figure, it will be appreciated that the frame is formed from a plurality of identically shaped groups of members which facilitates manufacturing and assembly of the same. In this regard, each of the end units A and B include two u-shaped members 11, 11 having barrier legs 12, 12 extending from a base 13. More particularly, the u-shaped members have the shape of an open rectangle. The cross members C, in the depicted embodiment are formed from a plurality of L-shaped members having an elongated barrier leg 14 terminating in a shorter barrier leg 15 disposed transversely at the end thereof. These L-shaped members are disposed with the free ends 16, 16 of the legs 14, 14 in abutting relation to form the cross member C. Removable fastening plates 18 secure the ends 16, 16 in place. It will be apparent, then, to assemble the frame one merely positions a pair of the u-shaped end members 11, 11 in facing relation to one another and connects one of the legs 12 thereof to the leg 15 of the L-shaped member by removable conventional C-clamps 17, 17 and uses a connector bar 19 to join the other legs 12 to complete the frame. C-clamps 17 are used to effect this connection. It will be appreciated that clamping means other than C-clamps may be used to join the individual sections or members of the playing surface in a relatively fixed embodiment of the game.

Figure 4:
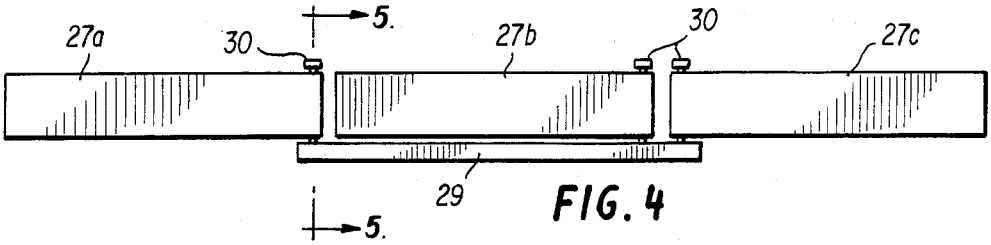
FIG. 4 is a side view of a gated cross member of the invention.
Figure 5:
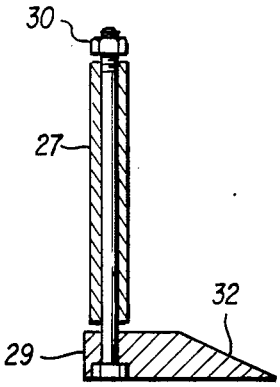
FIG. 5 is a cross sectional view of the gated cross member of FIG. 4 taken along line 5—5 showing further details of construction.

In FIGS. 4 and 5 there is shown a preferred construction of cross member C wherein the cross member C comprises three gate members 27*a*, 27*b*, and 27*c* pivotally and hingedly mounted on base threshold member 29 through hinge pins 30. Gate members 27 are designed to open in or out with respect to threshold 29 and consequently the playing course. Gate members 27 enable wheel chair or prosthesis bound patents to move onto the playing surface to retrieve their ball from a cup or for any other reason. Threshold member 29 is preferably provided with an incline 32 to facilitate the rolling of a wheel chair through the gate onto the playing surface. In the event that the game is to be set up on a surface without using floor pieces 26 an incline would be provided on both sides of the threshold member. It will be appreciated that the gates or cross member C enables the setting up of numerous hazard situations on a course as well as a variety of course configurations.

Figure 10:
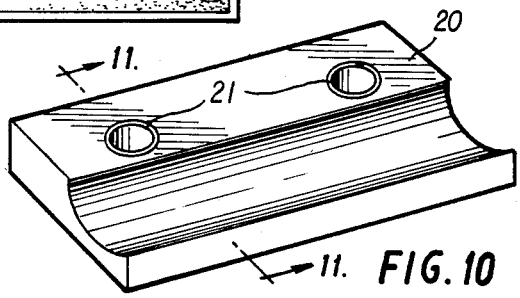
FIG. 10 is a perspective view of another greens embodiment of the invention.
Figure 9:
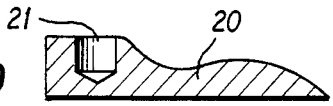
FIG. 9 is a sectional view taken along lines 7—7 of FIG. 8.
Figure 11:
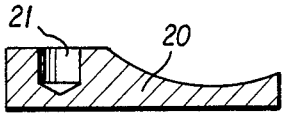
FIG. 11 is a sectional view taken along lines 9—9 of FIG. 10.

Two examples of configurations of greens members 20 are illustrated in FIGS. 8, 9, 10 and 11. In the illustrated embodiment of FIG. 8 the approach to the cup offers an incline, hill and dip (not numbered), while the green of Figure 10 provides a hazardous dip approach. It will be fully appreciated that the configuration of the greens may take many forms to make the game more interesting. Greens 20 are of such size and dimension as to simply be slid onto the u-shaped members 11. For simplicity, each of the greens are manufactured with two holes for the placement of the cups. When only one hole is required in a green, the other is covered by a cap (not illustrated).

Floor pieces 26 are preferably square shaped and designed to be simply laid in the desired course layout with edges abutting. At least one side of the floor piece members is the same width as the opening of the u-shaped members or the insertable greens members. For a more permanent course layout latch means, for example, hook and eyes (not shown) may be provided to interlock the members of the invention.

Figure 6:
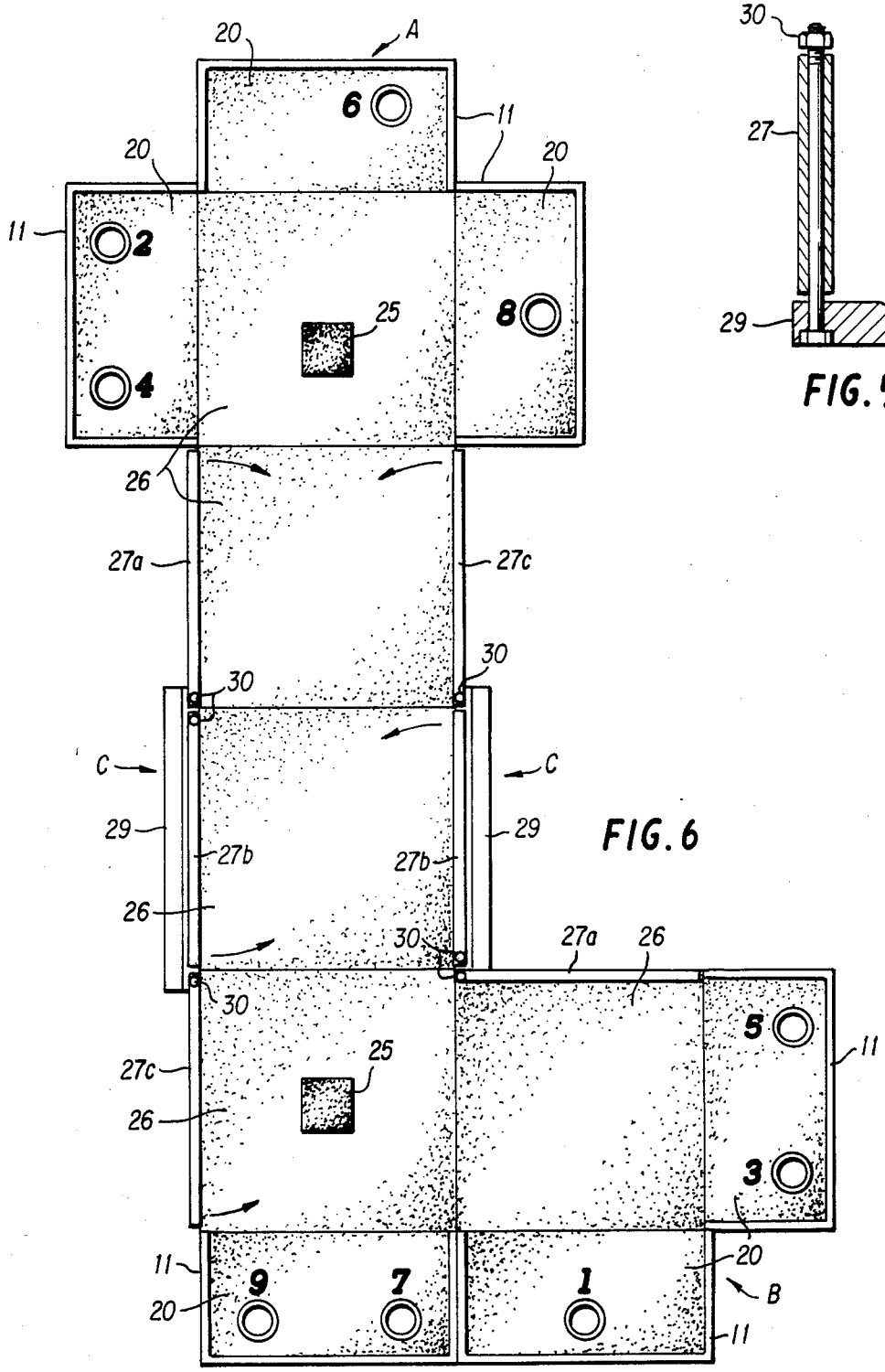
FIG. 6 is a top plan view of another embodiment of the invention illustrating a configuration using the gated cross members of the invention.

In the illustrated embodiment of FIG. 6 there is shown a course layout consisting of five floor piece members 26 laid in a "t" shape. End unit A has three u-shaped members 11 abutted to the floor pieces and end unit B has three u-shaped members abutted to form the bottom of the "t". Greens 20 are slidably engaged in the u-shaped members and abuted against the adjacent edges of the floor piece 26. The course is further enclosed by gated cross members C. It will be seen that the gates 27*a*, 27*b* and 27*c* of cross member C on the left side of the course are arranged in a straight line while gate 27*a* on the opposite of the course lies at a right angle to gate 27*b* thus forming a dog leg in the course. It will be observed that the course of FIG. 6 simply consists of five floor pieces 26, six u-shaped members 11, six greens 20 and two gated cross members C. It will be noted that the course may be entered through either of the gates 27*b*.

Figure 7:
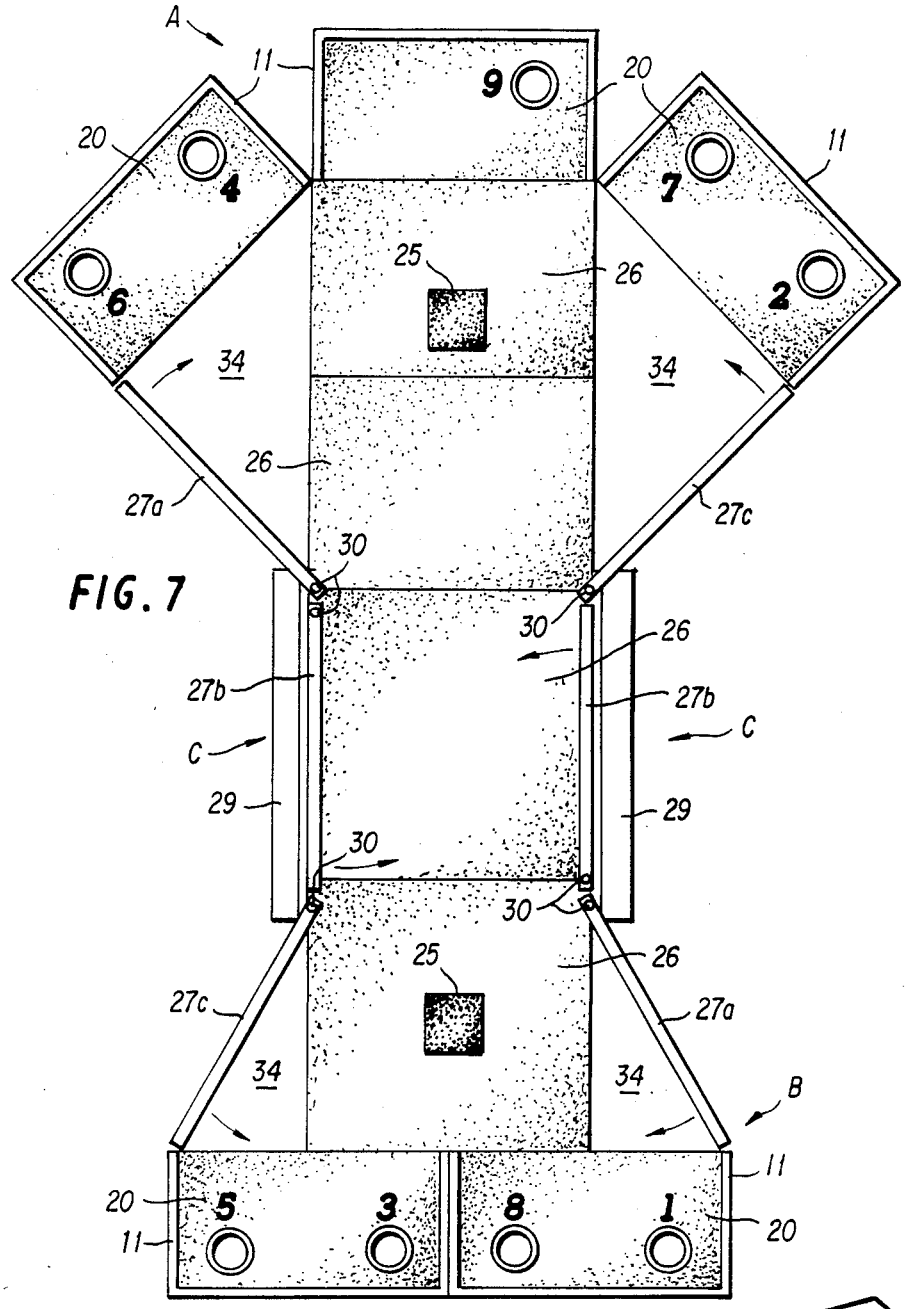
FIG. 7 is a top plan view of another course layout embodying the invention.
Figure 8:
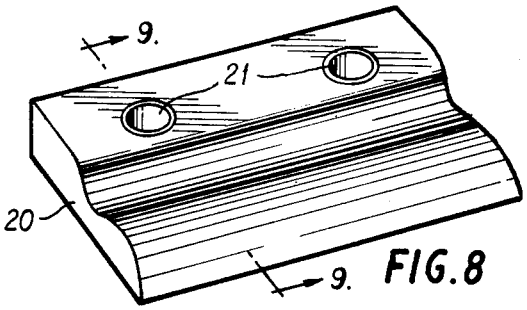
FIG. 8 is a perspective view of an embodiment of a greens configuration of the game.

FIG. 7 illustrates another course layout presenting different problems from the course layout illustrated in Figures 1 and 6 but achieved by simple rearrangement of the game set up illustrated in FIG. 6. The course layout of FIG. 7 is a generally "Y" shape which comprises only four floor pieces 26 and five u-shaped members 11. Gate members 27*a* and 27*c* are opened at an angle to enclose the fan shaped ends A and B of the course. The areas 34 not covered by a floor pieces 26 are hazards in this course layout. Areas 34 may be filled in with sand or any other material to present different types of hazards. The construction material for the members of the invention may be of very rigid material, for example, wood or high impact plastic.

It will be recognized that many variations and modifications of the invention may be made without departing from the spirit and scope of the invention, accordingly the invention is only limited by the claims.

I claim:

1. A golf game comprising a framework which includes a plurality of unitary barrier frame members each in the shape of an open rectangle, a plurality of greens members conforming with and slidably insertable in and enclosed by said open rectangle frame members, at least one golf cup disposed in each green, and barrier leg frame members for connecting the open rectangle frame members to form an enclosed playing course, said open rectangle frame members and said leg frame members being movable with respect to one another to form enclosed playing courses of varying configurations.

2. The golf game of claim 1 wherein the leg frame members comprise one or more gate members hingedly mounted on a base threshold member.

3. The golf game of claim 2 wherein said gate members open in and out with respect to the playing course.

4. The golf game of claim 2 wherein the leg frame member consists of three gate members each of said three gate members being pivotally hinged to a base threshold member disposed essentially under the middle of the three gates.

5. The golf game of claim 1 wherein the enclosed playing course comprises a covering material disposed over at least a part of the playing course to form a fairway.

6. The golf game of claim 1 comprising a plurality of floor pieces of such size and dimensions as to provide a fairway between greens within any configuration of the playing course.

7. The golf game of claim 6 wherein the floor pieces are square and the width of the square is the same as the width of said open rectangle frame members.

8. The golf game of claim 1 wherein the greens members have contoured surfaces forming hills, dips and inclines.

9. The greens members of claim 8 wherein one or more golf cups are provided.

10. The golf game of claim 1 wherein the said members sections form an H-shaped course layout.

11. The golf game of claim 1 wherein said members are joined to form a "t" shaped course layout.

12. The golf game of claim 1 wherein said members are joined to form a generally "Y" shaped course layout.

13. A golf game comprised of a framework, including a plurality of barrier members which are movable with respect to one another to form enclosed playing surfaces of varying configurations, at least one of said barrier members comprising a base threshold member and at least one gate member extending above said base threshold member and hingedly mounted on said base threshold member, said gate member swinging in and out with respect to the enclosed playing surface, covering material adapted to be disposed over any of said playing surfaces and at least one golf cup positioned in said covering material.

14. The golf game of claim 13 wherein the members are connected to form a frame which includes a section perpendicularly disposed to another.

* * * * *